US010344920B2

(12) United States Patent
Cao et al.

(10) Patent No.: US 10,344,920 B2
(45) Date of Patent: Jul. 9, 2019

(54) LIGHTING DEVICE

(71) Applicant: XIAMEN ECO LIGHTING CO. LTD., Xiamen (CN)

(72) Inventors: Liangliang Cao, Xiamen (CN); Lilei Su, Xiamen (CN); Wanzhen Li, Xiamen (CN); Maojin Zeng, Xiamen (CN); Xiaojuan Huang, Xiamen (CN); Lianwei Zhang, Xiamen (CN); Mingyan Fu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/860,670

(22) Filed: Jan. 3, 2018

(65) Prior Publication Data

US 2018/0283620 A1 Oct. 4, 2018

(30) Foreign Application Priority Data

Apr. 1, 2017 (CN) ..... 2017 2 0340840 U

(51) Int. Cl.

| | |
|---|---|
| ***F21V 21/00*** | (2006.01) |
| ***F21K 9/237*** | (2016.01) |
| ***F21K 9/232*** | (2016.01) |
| ***F21V 17/10*** | (2006.01) |
| *F21V 29/89* | (2015.01) |
| *F21Y 115/10* | (2016.01) |
| *F21V 29/508* | (2015.01) |
| *F21V 29/74* | (2015.01) |
| *F21K 9/238* | (2016.01) |
| *F21V 19/00* | (2006.01) |
| *F21Y 107/50* | (2016.01) |

(52) U.S. Cl.

CPC ..... *F21K 9/237* (2016.08); *F21K 9/232* (2016.08); *F21V 17/101* (2013.01); *F21K 9/238* (2016.08); *F21V 19/005* (2013.01); *F21V 29/508* (2015.01); *F21V 29/74* (2015.01); *F21V 29/89* (2015.01); *F21Y 2107/50* (2016.08); *F21Y 2115/10* (2016.08)

(58) Field of Classification Search

CPC ..... F21K 9/237; F21K 9/238; F21K 9/232; F21V 29/74; F21V 29/508; F21V 29/89; F21V 17/101; F21Y 2115/10

See application file for complete search history.

(56) References Cited

U.S. PATENT DOCUMENTS 6,787,999 B2 * 9/2004 Stimac ..... H05B 33/0803 315/51
9,410,687 B2 * 8/2016 Hussell ..... F21V 7/00
(Continued)

*Primary Examiner* — Ali Alavi
(74) *Attorney, Agent, or Firm* — Chun-Ming Shih

(57) ABSTRACT

A lighting device includes a filament, a filament fixing element, a driving circuit, a lamp holder and a bulb shell. The filament has a long strip bottom, installed with a plurality of LED modules. The filament fixing element has a bearing surface and a heat dissipation part. The bearing surface connects to the long strip bottom of the filament. The heat dissipation part is connected to the bearing surface to dissipate the heat. The driving circuit provides a suitable current to the filament for emitting light. The lamp holder houses the drive circuit and carries the filament fixing element. The bulb shell and the lamp holder constitute an accommodating space for receiving the filament and the filament fixing element.

17 Claims, 6 Drawing Sheets

(56) References Cited

U.S. PATENT DOCUMENTS

| | | | | |
|---|---|---|---|---|
| 2005/0174769 | A1* | 8/2005 | Yong | F21V 3/02 362/235 |
| 2010/0253221 | A1* | 10/2010 | Chiang | F21K 9/00 315/32 |
| 2011/0248631 | A1* | 10/2011 | Chuang | F21V 3/00 315/32 |
| 2012/0032577 | A1* | 2/2012 | Huang | F21V 3/02 313/318.01 |
| 2012/0217862 | A1* | 8/2012 | Matsuda | F21K 9/232 313/46 |
| 2013/0049031 | A1* | 2/2013 | Matsuda | H01L 33/486 257/88 |
| 2013/0058080 | A1* | 3/2013 | Ge | F21V 3/00 362/231 |
| 2014/0152177 | A1* | 6/2014 | Matsuda | F21K 9/90 315/32 |
| 2017/0191623 | A1* | 7/2017 | Ma | F21K 9/237 |

* cited by examiner

LIGHTING DEVICE

FIELD OF THE INVENTION

The present invention relates to a lighting device, and more particularly to a LED lighting device.

BACKGROUND OF THE INVENTION

Light-emitting diode (LED) lights are a new lighting source, because of its high luminous efficiency, long life span, energy saving, vandal-resistant, and environmental, it has been gradually used in home, office, public facilities, etc.

LED light bulbs are a new type of energy-saving light to replace traditional incandescent bulbs. The traditional incandescent light bulbs and tungsten filament light bulbs are with high energy consumption and short lifetime. Because of the depletion of natural resources, the traditional incandescent light bulbs and tungsten filament light bulbs have been gradually banned to product by the governments around the world. Followed by compact fluorescent lamps, the compact fluorescent lamps are designed as a replacement for the traditional incandescent light bulbs and tungsten filament light bulbs. Although the compact fluorescent lamps saved energy, the manufacturing process of the compact fluorescent lamps requires a lot of heavy metals which would lead to environmental pollution, and is contrary to the big trend of environmental protection. With the rapid development of LED technology, LED lighting has become a new choice of green lighting. LED is much better than traditional lighting products in the lighting principle, energy saving, and environmental protection. As the incandescent light bulbs and compact fluorescent lamps still occupy a very high proportion in people's daily life, in order to reduce waste, LED lighting manufacturers must develop LED lighting products which are in line with the existing interface and the using habit, thus users can use the new LED lighting products without replace the original traditional lighting base and line. Therefore, LED light bulbs are emerged at the right moment. LED light bulbs use the existing interface, that is, screw and socket, and even imitates the shape of the incandescent light bulbs to conform to people's habits.

The current LED light bulbs have met the basic requirements to apply, and the price is also acceptable. However, because of the better appearance or light angle of the LED filament light bulbs and the similar appearance to the traditional incandescent, the LED filament light bulbs have been accepted as the final version of the LED light bulbs. But the LED filament light bulbs are still unable to implement to the market in quantity, by reason of the high prices of the LED filament material. Although mass production or modifying the material specification may reduce the cost of materials, there are still some problems in the current process yield. The current cost of LED filament can't be reduced. And because of the shape of the LED filament itself, it is difficult to dissipate heat, it will not only accelerate the light failure of the LED filament, more seriously affect the life span of LED filament. How to improve heat dissipation capability of the LED filament is an important question in the development of LED lighting device.

Therefore, the present invention proposes a new method for fixing LED filaments, fixing the LED filaments through a simple template, and then installing it in the bulb shell of a high power bulb lighting device, the simple template is of heat dissipation and by changing assembly ways of the template, the lighting type of the bulb can be changed rapidly to enhance the convenience of assembly and reduce the cost of the process.

SUMMARY OF THE INVENTION

The embodiment of the present invention includes a high power bulb lighting device, fixing the LED filaments through a simple template, thus the LED filaments installed in the simple template, and the simple template installed in the bulb shell of the high power bulb lighting device. By changing the assembly ways of the template, the lighting type of the bulb can be changed rapidly to enhance the convenience of assembly. Because the LED filament is installed in the simple template which has a large adhesive area, the stability of the LED filaments can be effectively enhanced.

Specifically, the embodiment of the present invention includes a lighting device. The lighting device includes a filament, a filament fixing element, a driving circuit, a lamp holder and a bulb shell.

The filament has a long strip bottom, installed with a plurality of LED modules.

The filament fixing element has a bearing surface and a heat dissipation part. The bearing surface is connected to the long strip bottom of the filament. And the heat dissipation part is connected to the bearing surface to dissipate the heat of the bearing surface through the heat dissipation part.

The driving circuit provides a suitable current to the filament for emitting light. The lamp holder houses the driving circuit and carries the filament fixing element. The bulb shell and the lamp holder constitute an accommodating space for receiving the filament and the filament fixing element. The gas with high thermal conductivity can be filled into the bulb shell, and further increase the heat dissipation.

In one embodiment, the filament fixing element includes a metal plate. The bottom of the metal plate is fixed to the lamp holder. The top surface of the metal plate is provided with the bearing surface. In other words, the filament may be set on the top of the metal plate. By designing the shape and height of the metal plate, it is possible to set the height and the position of the filament in the accommodating space of the bulb shell.

A main portion of the metal plate is used as the heat dissipation part. For example, the metal plate may be entirely or partially made of aluminum, and the heat generated by the filament when lighting can be transferred, to achieve an effect of rapid cooling. In other words, through such a structure design, high-power lighting devices can be produced, such as lighting with a high wattage filament directly.

In another embodiment, the filament fixing element may have two or more metal plates. The top surface of the two or more metal plates is provided with the bearing surface for carrying two or more filaments. In other words, a plurality of metal plates may be provided in the accommodating space of the bulb shell. On the other hand, the two or more metal plates can be connected to each other to form a three-dimensional unfolded structure, so that the two or more filaments are emitted in different directions. Of course, the two metal plates can also be separated, it is not necessary to be connected.

In another embodiment, there is a corresponding card slot between the two or more metal plates for stabilizing the three-dimensional expanded structure of the two or more metal plates. For example, a corresponding card slot may be provided between the two metal plates, and the two metal plates are cross-linked through the card slot to form a cross structure.

In another embodiment, the bearing surface of the filament fixing element includes a groove for arranging the filament.

In another embodiment, the filament fixing element has at least one hollow hole. In other words, in addition to a complete plate, the metal plate can also set up one or more hollow holes with different shapes based on different demands, such as reducing material costs.

In another embodiment, the filament fixing element may be hung or attached with additional sub-light-bar fixing elements. The one or more sub-light-bar fixing elements are connected to the filament fixing element, and the sub-light-bar fixing element is also provided with a filament.

In another embodiment, the filament may be fixed to the filament fixing element by gluing. And, in order to achieve better heat dissipation effect, heat dissipation glue would be selected.

In another embodiment, the driving circuit may also be directly or indirectly thermally connected to the filament fixing element. For example, the substrate of the driving circuit is contacted with the filament fixing element directly or through another heat conducting element indirectly, so that the heat of the driving circuit can also be dissipated through the filament fixing element.

In another embodiment, the lamp holder may be provided with a heat dissipation element such as a cup-like heat dissipation. The heat dissipation element of the lamp holder assists the filament fixing element to dissipate heat.

In another embodiment, the filament is provided with a flexible substrate. And the plurality of LED modules is provided on the flexible substrate. The bearing surface of the filament fixing element is curved such that the long strip bottom of the filament is maintained in bent in a predetermined shape.

In another embodiment, the filament fixing element further includes a conductor for directing the current of the driving circuit to the filament. This conductor can be provided by setting a conducting wire on a metal plate or other way. For example, an insulating portion may be provided on the metal plate of the filament fixing element, dividing the metal plate into two conductors, and for connecting the electrical terminals from the driving circuit with the different polarity, respectively.

In another embodiment, the filament fixing element has a clip which fixes the filament in an elastic holding manner and provides the conduction of the filament current. In other words, the filament can be inserted directly into the clip of the filament fixing element. For example, the electrical connection terminals may be provided on either side of the filament. And these electrical connection terminals may be inserted into the clip of the filament fixing element, for example, through a shrapnel or spring to hold and fix the filament, at the same time, to achieve the electrical connection.

In another embodiment, the filament fixing element includes a transparent material such that the filament is visually suspended in the accommodating space of the bulb shell. For example, the filament fixing element may be a transparent plastic with heat dissipation.

In another embodiment, the filament fixing element may be a cross-shaped three-dimensional structure. This structure is easy to assemble and can maintain a stable three-dimensional structure.

In another embodiment, the heat dissipation part of the filament fixing element includes fins or other heat-dissipating structures.

In another embodiment, the heat dissipation part of the filament fixing element may also be a mesh-like metal, it is not necessary to be a support arm or a plate.

In another embodiment, the filament fixing element may have an optical surface for guiding the light emitted by the filament to a predetermined direction. For example, the filament fixing element is a plate, and a reflective coating is provided on its surface for guiding the light for a better light efficiency. In addition, the filament fixing element may be made of a light guide plate or the light guide plate may be attached on the filament fixing element for guiding the light or producing a better predetermined visual effect.

In another view, the high power bulb lighting device includes a lamp holder, a bulb shell and a filament fixing element. There is a driving board installed in the lamp holder. The driving board includes a plurality of driving circuit elements. The bulb shell is a hollow shell, covering the lamp holder. The LED filament is arranged on the surface of the filament fixing element, and the filament fixing element is arranged in the inner space of the bulb shell.

In such a high power bulb lighting device, the filament fixing element may be made entirely of aluminum. However, the filament fixing element may be made partially of aluminum, and the other portion of the filament fixing element may be made of different materials. The filament fixing element may also be selected from copper or other metal material, depending on the different requirements about the heat dissipation, the styling or the appearance, and may also be made of glass. Through this way, the high power bulb lighting device may be of different styles.

The surface of the filament fixing element may be provided with a plurality of convexities or ripples, thus increasing the heat dissipation area and increasing cooling efficiency. The surface of the filament fixing element can also be installed with fins, through the fins to strengthen the heat convection of the air, and to enhance the cooling efficiency.

In such a high power bulb lighting device, the filament fixing element may be a solid plate, or it may be an empty plate, and the empty plate can enhance the richness of the mold and reduce the manufacturing cost and reduce the weight of the bulb.

In such a high power bulb lighting device, the filament fixing element may have one or more groups. When there are two groups of the filament fixing elements, one group is provided with grooves on the surface and the other group is smaller in size, combined with the first group in a cross-staggered manner through said grooves, and the LED filament is disposed on the surface of the filament fixing elements. When there are three groups of filament fixing elements, one group is provided with a plurality of grooves on the surface and the other two groups are combined with the first group in a cross-staggered manner through the grooves, and the LED filament is disposed on the surface of the filament fixing element.

When filament fixing elements are more than one group, the surface of one filament fixing element may have one or more holes, the other groups of are fixed through the holes to form different combinations of filament fixing elements. According to the different designs, different direction of the holes or the grooves, the filament fixing elements would form a plurality of different staggered assembling combination.

In this high power bulb lighting device, the filament fixing element is a flat plate, and the thickness of the flat plate may be selected in a variety of ways. The thickness increasing, the heat dissipation efficiency is higher; the thickness decreasing, the cost is reduced, as a more lightweight high power bulb lighting device formed. Therefore, by changing the thickness of the filament fixing element, it is possible to meet the different requirements, no matter what the requirements of heat dissipation, appearance or cost are.

In this high power bulb lighting device, the LED filament may be set on the side of the filament fixing element or on the plane of the filament fixing element, the number of LED filament may be adjusted according to different demands, the number of LED filaments may be one or more groups, and the installation direction and angle may be different. The LED filament may be adhered to the side or the plane of filament fixing element by gluing, or may be fixed to the side or the plane of filament fixing element by welding. In the other fixing methods of the LED filament fixing element, one or more groups of grooves may be provided on the side or the plane of the filament fixing element, and the LED filament may be fitted in the groove, to fix the LED filament to the side or plane of the filament fixing element.

In this high power bulb lighting device, the filament fixing element may be arranged with a reflecting element which can change the advancing angle of the light, focus the light emitted by the LED filament, or diffuse reflection, so that the high power bulb lighting device has different lighting forms.

In this high power bulb lighting device, the lamp holder may additionally be provided with a heat dissipation element. The heat dissipation element may be a cooling fin, a fan, a loop tube, or a heat dissipation glue, and the heat dissipation efficiency can be effectively enhanced by the heat dissipation element.

In this high power bulb lighting device, the bulb shell may be made of translucent or semi-translucent material. The bulb shell made of translucent material may provide bright light, and the bulb shell made oft semi-translucent material may provide relatively soft light. The transparency degree of the bulb shell can change the light atmosphere. There are many possibilities for the shape of the bulb shell, it may be spherical, water-drop, flame, square, cylindrical or other shapes.

DETAILED DESCRIPTION

The present invention relates to a high power bulb light device, fixing the LED filament through a simple template, the LED filament installed in the simple template, and the simple template installed in the bulb shell of the high power bulb lighting device. By changing the assembly ways of the template, the lighting type of the bulb can be changed rapidly to enhance the convenience of assembly. At present, LED lighting devices often face problem that the LED filament is not easy be fixed, the damage rate of the process is high. In the present invention, the LED filament is set on the template, the LED filament has a large adhesive area, thus it can effectively enhance the stability of the LED filament, improving product yield. The LED lighting device uses the LED filament as a light emitting source, instead of the original LED light bead. The LED filament is formed by encapsulating the chip on an elongated substrate, connecting the chips with gold wires to make conductive, and the surface of the substrate is coated with yellow phosphor. The LED filament can realize full angle light emission, and can be as a three-dimensional light source without adding the lens. Because of the large light emitting area, the problem of glare may be improved. So the LED filament is a good light source, can bring an unprecedented lighting experience.

The preferred embodiments of the present invention are given below, which is intended to be illustrative of the invention and should not to be construed as the limiting of the invention.

Figure 1:
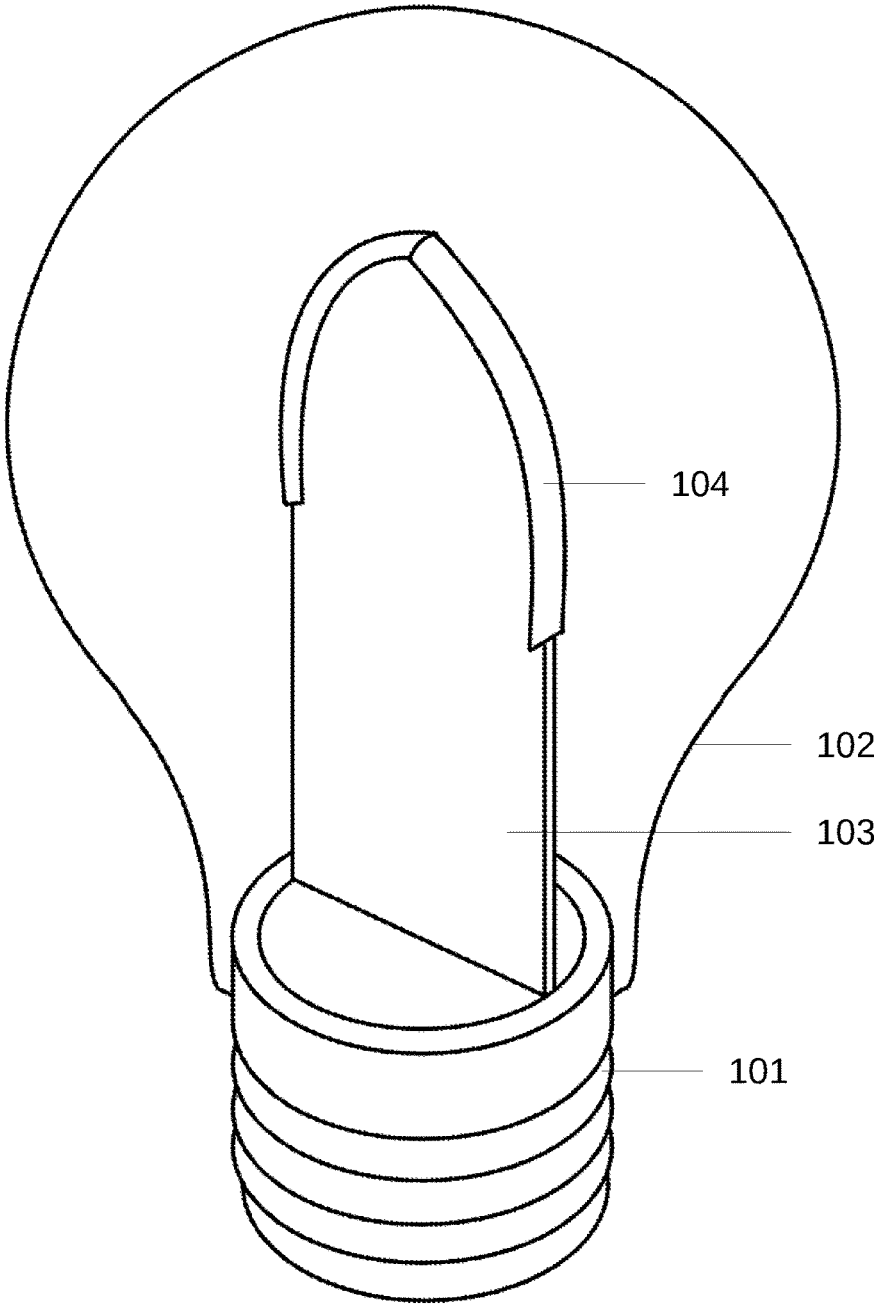
FIG. 1 shows a side view of the high power bulb lighting device according to the first embodiment of the present invention.

Please refer to FIG. 1. FIG. 1 shows a side view of the high power bulb lighting device according to the first embodiment of the present invention. In FIG. 1, the high power bulb lighting device comprises a lamp holder 101, a bulb shell 102 and a filament fixing element 103. A driving board is installed in the lamp holder 101, and the driving board comprising a plurality of driving circuit elements. The bulb shell 102 is a hollow shell, covering the lamp holder 101. The LED filament 104 is arranged on the surface of the filament fixing element 103, and the filament fixing element 103 is arranged in the inner space of the bulb shell 102.

Figure 2:
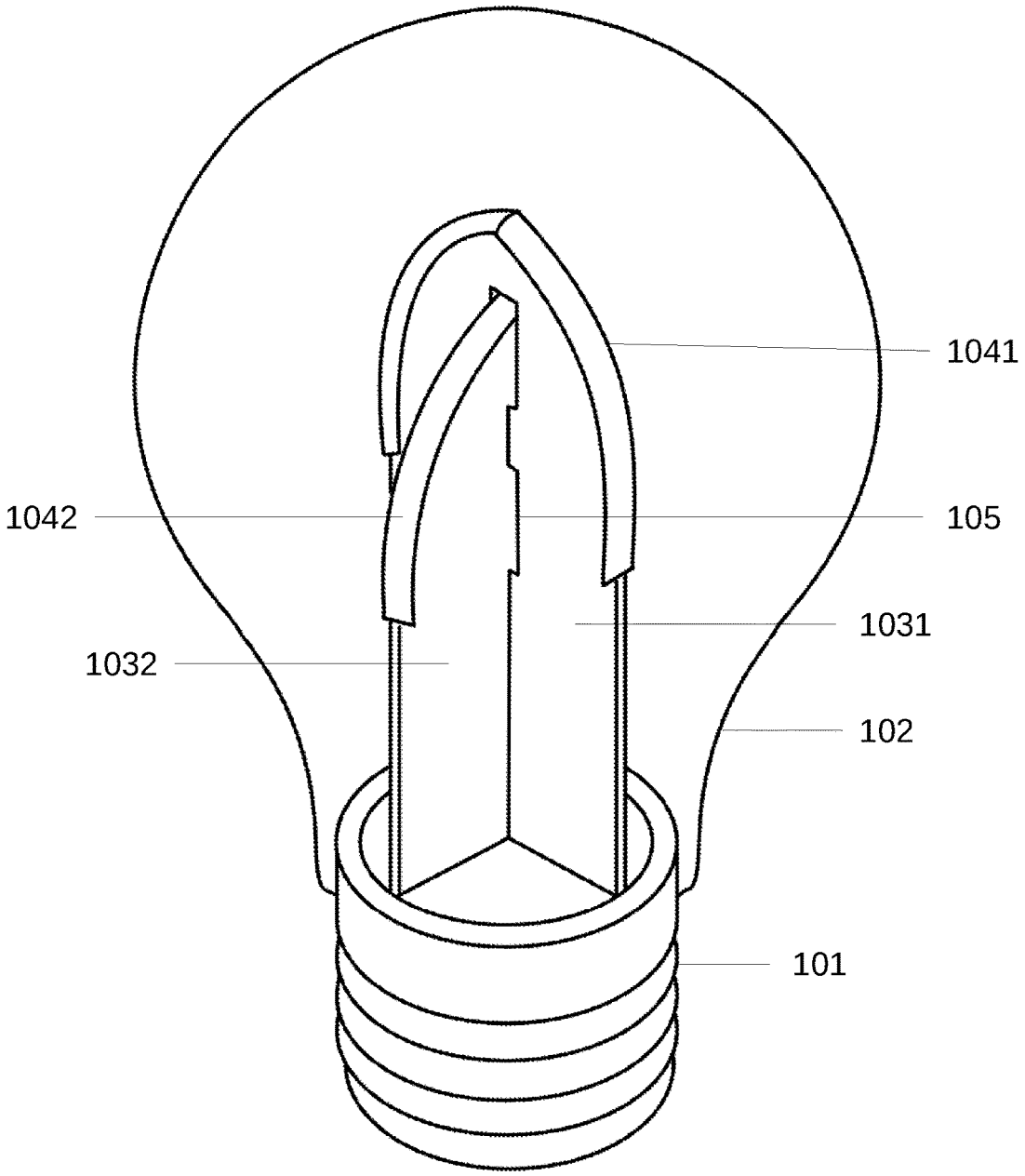
FIG. 2 shows a side view of the high power bulb lighting device according to the second embodiment of the present invention.
Figure 3:
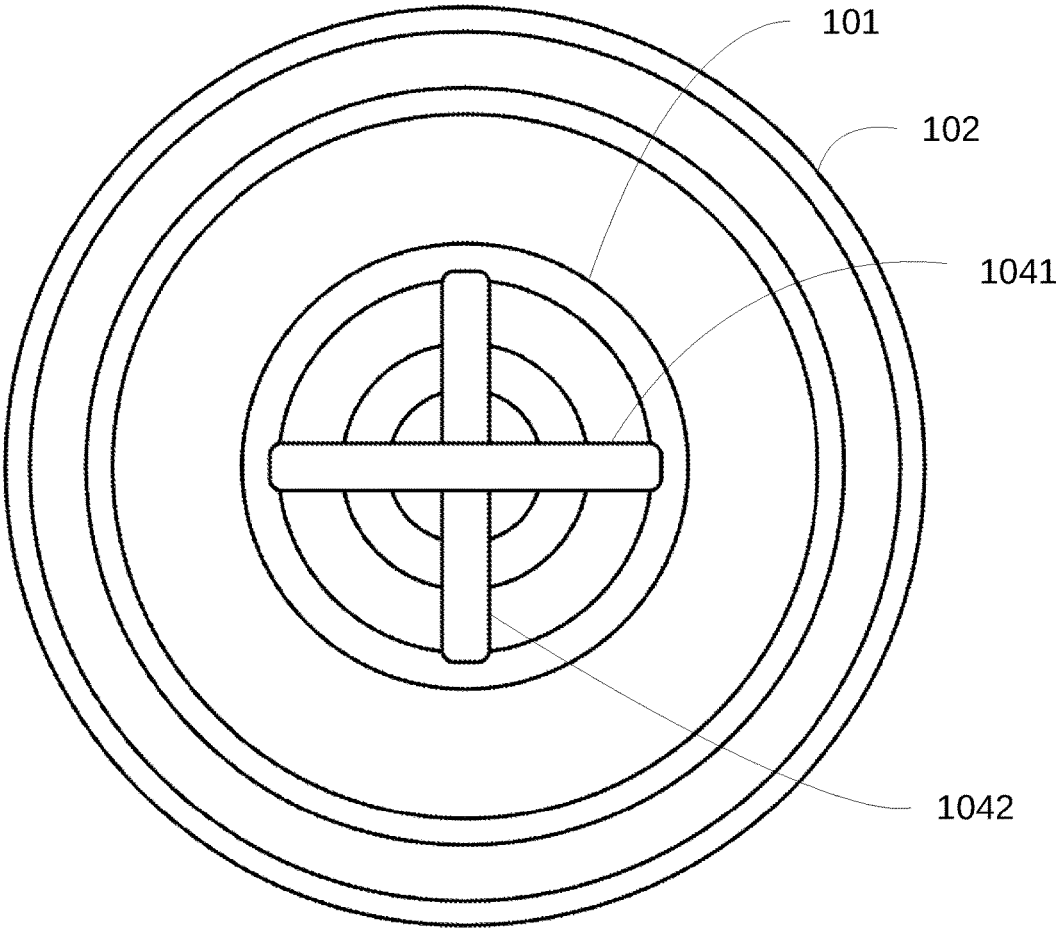
FIG. 3 shows a top view of the high power bulb lighting device according to the second embodiment of the present invention.

In the high power bulb lighting device, the filament fixing elements 103 in FIG. 1 may have one or more groups. Please refer to FIG. 2 and FIG. 3. FIG. 2 and FIG. 3 shows a side and top view of the high power bulb lighting device according to the second embodiment of the present invention. In FIG. 2, there are two groups of the filament fixing elements 1031, 1032, one of the filament fixing elements 1031 is provided with grooves 105 on the surface. The LED filament 1041 is set on the side of the filament fixing element 1031. The other filament fixing element 1032 is smaller in size, the LED filament 1042 is set on the side of the filament fixing element 1032. The filament fixing element 1032 pass through the grooves 105, and combine with the filament fixing element 1031 in a cross-staggered manner, as shown in FIG. 3.

Figure 4:
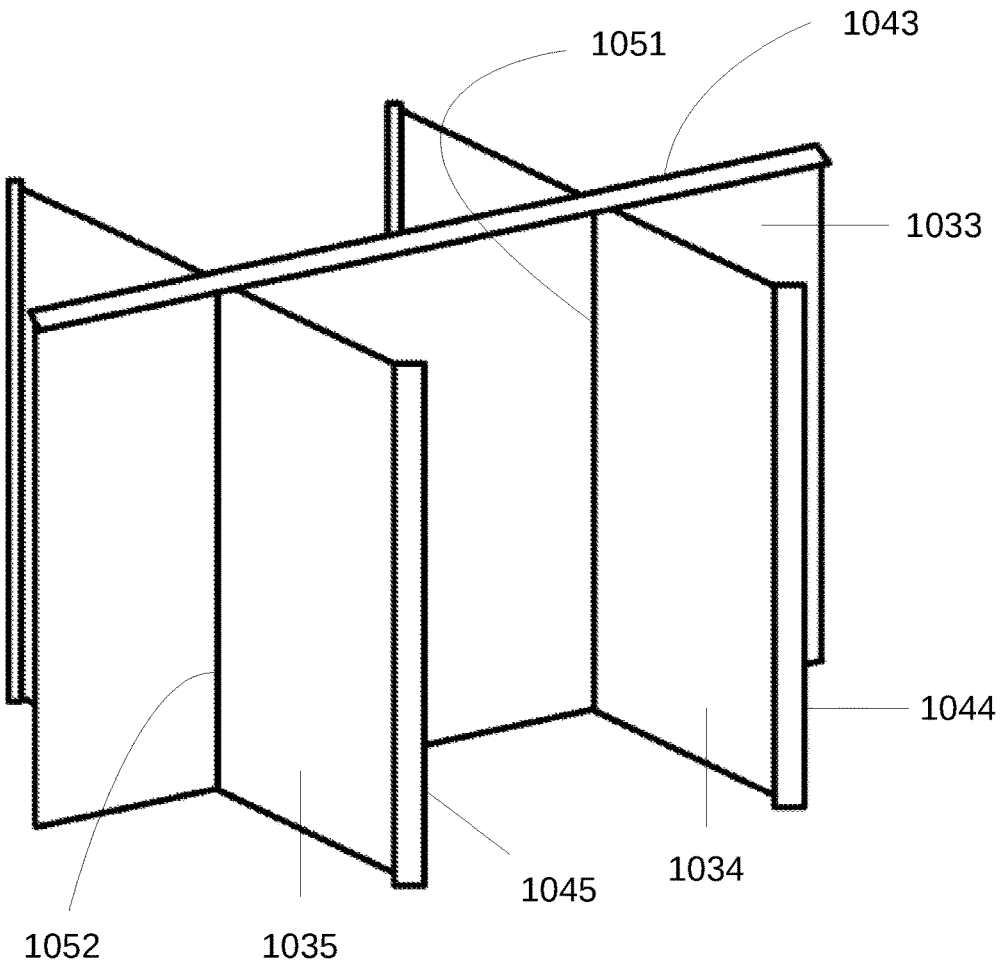
FIG. 4 shows an assemble schematic view of the filament fixing element according to the third embodiment of the present invention.

In other embodiments of the present invention, the filament fixing element 103 in FIG. 1 may have three groups. Please refer to FIG. 4. FIG. 4 shows an assemble schematic view of the filament fixing element according to the third embodiment of the present invention. When there are three groups of the filament fixing element 1033, 1034, 1035, the filament fixing element 1033 is provided with grooves 1051, 1052 on the surface, the LED filament 1043 is set on the side of the filament fixing element 1033, the filament fixing element 1034 pass through the groove 1051, the filament fixing element 1035 pass through the groove 1052, and achieving a cross-staggered manner. The LED filament 1044 is set on the side of the filament fixing element 1034, the LED filament 1045 is set on the side of the filament fixing element 1035.

Figure 5:
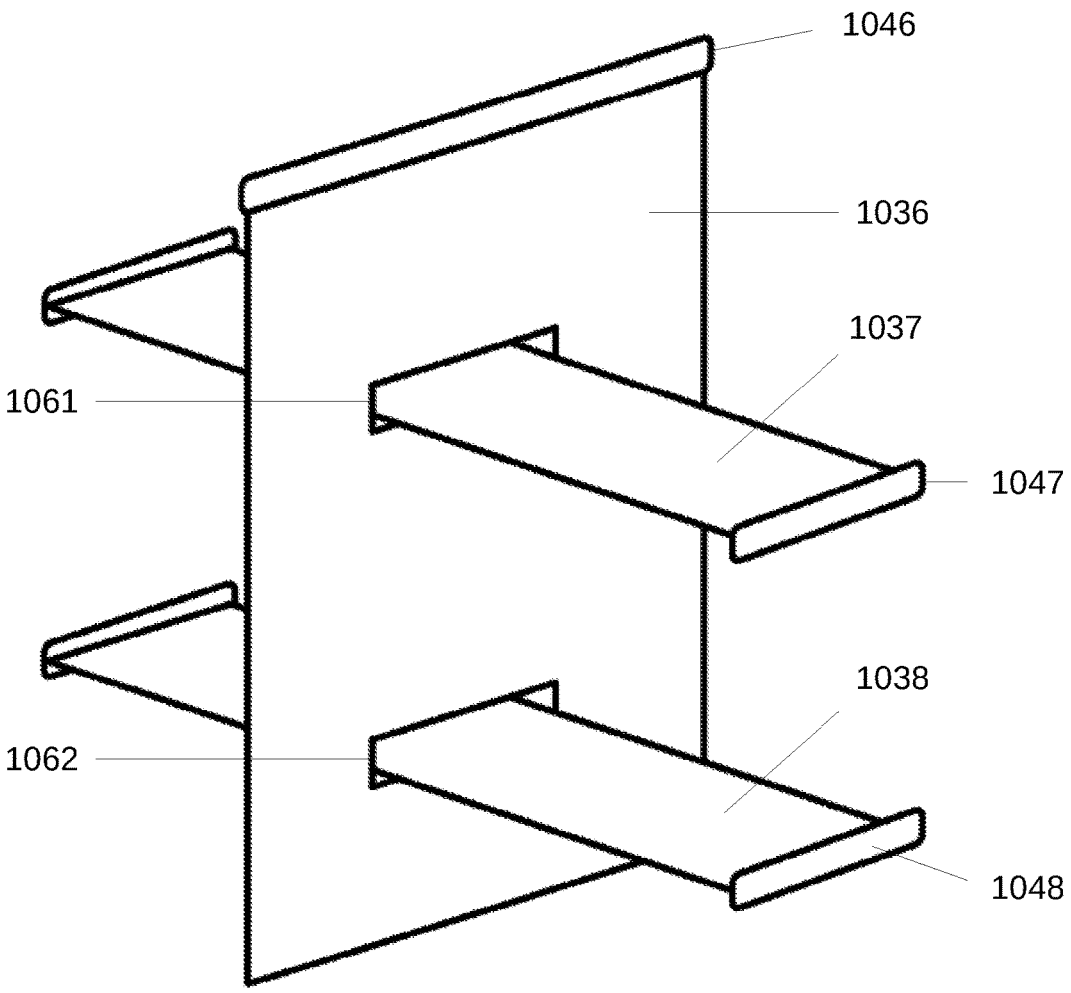
FIG. 5 shows an assemble schematic view of the filament fixing element according to the fourth embodiment of the present invention.

When the filament fixing element 103 in FIG. 1 are more than one group, please refer to FIG. 5. FIG. 5 shows an assemble schematic view of the filament fixing element according to the fourth embodiment of the present invention. In FIG. 5, the surface of the filament fixing element 1036 may have two holes 1061, 1062, the filament fixing element 1037 is fixed through the holes 1061, the filament fixing element 1038 is fixed through the holes 1062. The LED filament 1046 is set on the side of the filament fixing element 1036, the LED filament 1047 is set on the side of the filament fixing element 1037, the LED filament 1048 is set on the side of the filament fixing element 1038, and forming a combination of the filament fixing elements 103 different from that in FIG. 1.

According to the different designs, different direction of the holes or the grooves, the filament fixing elements would form a plurality of different staggered assembling combinations.

Figure 6:
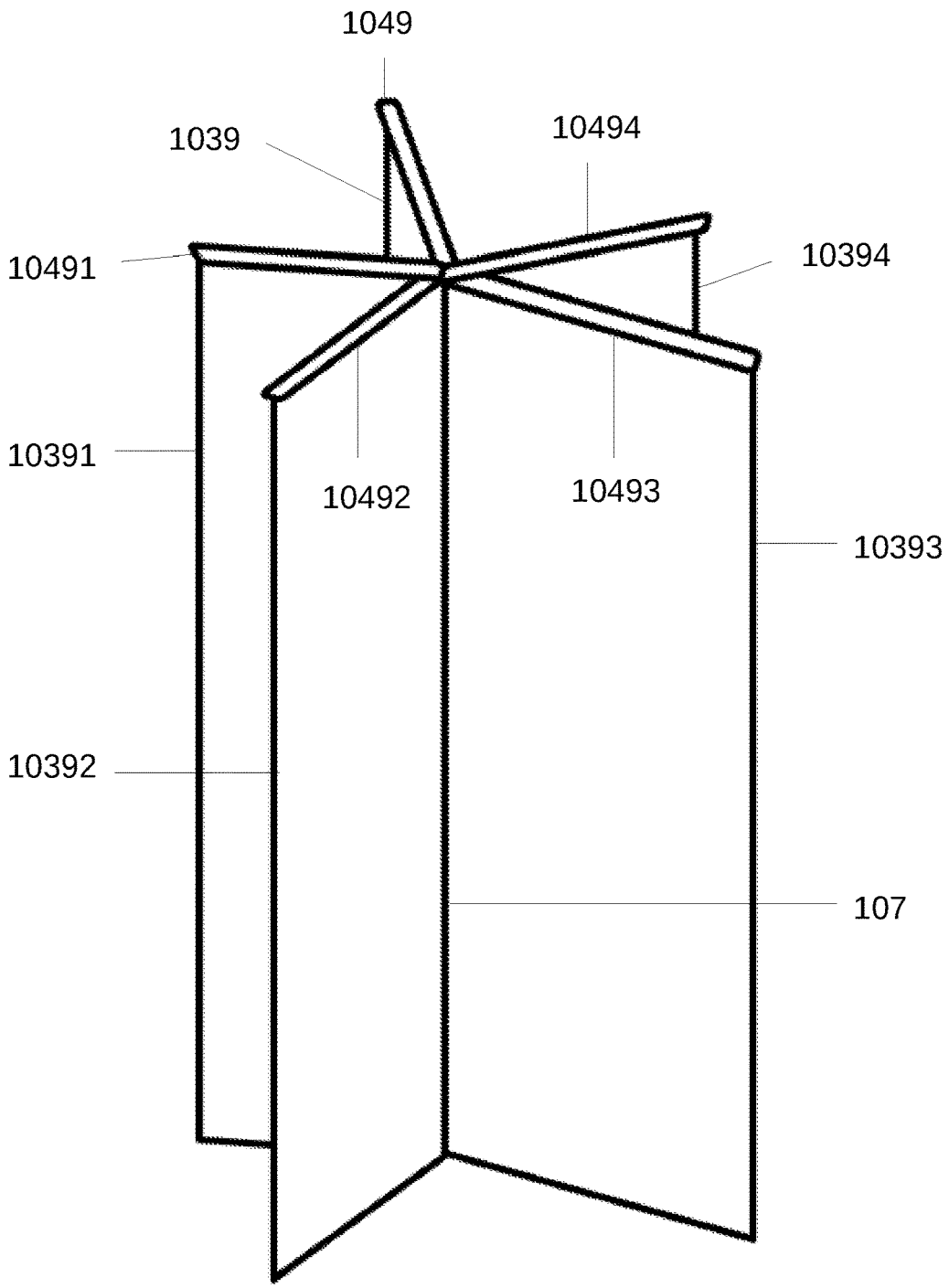
FIG. 6 shows an assemble schematic view of the filament fixing element according to the fifth embodiment of the present invention.

Please refer to FIG. 6, FIG. 6 shows an assemble schematic view of the filament fixing element according to the fifth embodiment of the present invention. In this embodiment, the high power bulb lighting device is provided with a multiple rails 107. The multi rails 107 is provided with a plurality of groups of clip, each clips corresponds to the filament fixing elements 1039, 10391, 10392, 10393, 10394, and the LED filaments 1049, 10491, 10492, 10493, 10494 are set on the side of the filament fixing elements 1039, 10391, 10393, 10392, 10394, respectively. The filament fixing elements 1039, 10391, 10392, 10393 and 10394 are inserted into the groove of the rails 107, paralleled to the direction of the rail 107 and expanded in fan-shaped.

Of course, FIGS. 1, 2, 3, 4 and 5 are merely examples, and other possible approaches may also be in the spirit of the present invention. For example, in such a high power bulb lighting device, the filament 104 may be entirely made of aluminum, and filament fixing element 103 may only be partially made of aluminum, and the other portions may be made of different materials. Aluminum is a chemical element, belonging to the boron family, the chemical symbol is Al. Aluminum is a softer and easy-to-extend silver-white metal. Aluminum is the third element in abundant in the crust (after oxygen and silicon) and is also the first metal in abundance, accounting for about 8 percent of the earth's mass in the solid surface. Aluminum is chemically active, so it is difficult to find a free metal aluminum unless it is in an extremely special redox environment. More than 270 minerals have been found. Aluminum is valued for its low density and corrosion resistance (due to passivation). Structure parts made of aluminum and its alloys are not only critical in the aerospace industry, but are also important in the field of transportation and structural materials. The filament fixing element may also be selected from copper material or other metal material, depending on the different requirements of the heat dissipation, the styling or the appearance to change, it may also be made of glass, so that this high power bulb lighting device may be of different styles.

Please refer to FIG. 1, in this embodiment, the surface of the filament fixing element 103 may be provided with a plurality of convexities or ripples, thus increasing the heat dissipation area and increasing cooling efficiency. The surface of the filament fixing element 103 can also be installed with fins, through the fins to strengthen the heat convection of the air, and to enhance the cooling efficiency. In general, the variables related to the heat dissipation include heat dissipation area, temperature difference, airflow velocity and length of airflow direction. The greater heat dissipation area, the better heat dissipation. If the heat dissipation area doubles, the heat dissipation will be doubled. The higher temperature difference, the higher heat dissipation. Therefore, the heat dissipation is often made of aluminum, copper, aluminum alloy or copper alloy, which can effectively transmit heat from the heat source.

Please refer to FIG. 2. In this embodiment, the filament fixing element 1031 is a solid plate, provided with the groove 105, but this is one of the possible designs of filament fixing element 1031. The filament fixing elements 1031, 1032 may be made of other different materials and with different shapes. For example, the filament fixing elements 1031, 1032 may be a solid plate, or it may be an empty plate. The empty plate can enhance the richness of the mold, reduce the manufacturing cost and reduce the weight of the bulb. In other embodiments of the present invention, the filament fixing elements 1031, 1032 are a flat plate, and the thickness of the flat plate may be selected in a variety of ways. As the thickness of the flat plate increase, the heat dissipation efficiency is higher. As the thickness of the flat plate decrease, the cost is reduced, and forming a more lightweight high power bulb lighting device. Therefore, by changing the thickness of the lamp fixing member, it is possible to meet the different requirements, no matter what the requirements of heat dissipation, appearance or cost are.

FIG. 1 illustrates an embodiment of the invention, but there are many possibilities for the fixed position of the filament 104. For example, the LED filament 104 may be set on the side of the filament fixing element 103 or on the plane of the filament fixing element 103, the number of LED light 104 bar may be adjusted according to different demands, the number of LED filament 104 may be one or more groups, and the installation direction and angle may be different. The LED filament 104 may be adhered to the side or the plane of filament fixing element 103 by gluing, or may be fixed to the side or the plane of filament fixing element 103 by welding. In the other fixing methods of the LED filament fixing element 103, one or more groups of grooves may be provided on the side or the plane of the filament fixing element 103, and the LED filament 104 may be fitted in the groove, to fix the LED filament to the side or plane of the filament fixing element.

FIG. 2 illustrates an embodiment of the invention, but there are many types of the filament fixing elements 1031, 1032, for example, the filament fixing element 1031 or 1032 may be arranged with a reflecting element which can change the advancing angle of the light, focus the light emitted by the LED filament 1041, 1042, or diffuse reflection, so that the high power bulb lighting device has different lighting forms. The reflective element can improve the light utilization rate of the lighting device, and improve the efficiency of the lighting device. The reflectivity rate of reflective element is mainly dependent on the material. The reflectivity of reflective material and the degree of light failure will directly determine the quality of the reflective element.

In other embodiments of the present invention, the lamp holder 101 in FIG. 1 may additionally be provided with a heat dissipation element. The general common heat dissipation methods include natural convection heat dissipation, fan forced heat dissipation, heat pipe and loop heat pipe heat dissipation, etc. Natural convection is directly contacted with the air through the radiator, and the air around the radiator becomes hot air because it absorbs heat. Then the hot air rises and the cold air drops, which naturally leads to the convection of the air and the heat dissipation. The common radiator has the cooling fins, the bulb shell and the driving plate of the lighting device, with the introduction of high power lighting device, a large heat dissipation surface area is needed for the use of natural convection cooling, so the heat dissipation fins are widely used in the various LED lighting devices. Fan forced heat dissipation is a complex system with low reliability; Heat pipe and loop heat pipe heat dissipation is of high cost. Therefore, in this high power bulb lighting device, the lamp holder may additionally be provided with a heat dissipation element. The heat dissipation element may be a cooling fin, a fan, a loop tube, or a heat dissipation glue, and the heat dissipation efficiency can be effectively enhanced by the heat dissipation element.

The cooling fin in the field of electronic engineering design are classified as passive cooling elements, attached with a metal with high thermal conductivity, light-weight, easy to machine on the hot surface, to dissipate heat in a composite heat exchange mode. The cooling fins do not require additional drive energy to dissipate heat, and are the most typical passive heat dissipate element. In order to enhance the heat dissipation efficiency of the cooling fins, there are generally two methods, one is to apply a thermal paste between the two surfaces, rather than directly contacting the heating surface, and the thermal paste is capable of enhancing the heat transfer efficiency, better than the direct contact of the two metals; the other is to increase the heat dissipation area of the fins, the mothed for increasing heat dissipation area is to design the cooling fins with grooves.

The LED lighting devices, like all electronic parts, generally produce heat and rise temperature during use or operation. If the heat dissipation problem is ignored, the LED lighting device will be burned down due to high temperature. The LED lighting devices are designed to be more complex than traditional lighting devices, including optics, mechanisms, electronics and heat dissipation, where "heat dissipation" is particularly important. Because the current conversion rate of the high power LED lighting device is only 20 percent, it will be converted into light, the remaining 80 percent will be converted to heat. If the heat of the lighting device can't be transmitted out, it will cause serious light failure, and may even damage the lighting device.

In this high power bulb lighting device, the bulb shell 102 in FIG. 1 may be made of translucent or semi-translucent material, and the bulb shell 102 made of translucent material may provide bright light, and the bulb shell made oft semi-translucent material may provide relatively soft light, so that the transparency degree of the bulb shell can change the light atmosphere. There are many possibilities for the shape of the bulb shell 102, it may be spherical, water-drop, flame, square, cylindrical or other shapes. In general, the bulb shell of the LED light source must have the following characteristics: high light transmission, high diffusion, less glare effect, no light shadow, good light source concealment, light transmission rate to a certain extent or more, high flame resistance and high impact resistance.

In addition to the above-described embodiments, various modifications may be made, and as long as it is within the spirit of the same invention, the various designs that can be made by those skilled in the art are belong to the scope of the present invention.

The invention claimed is:

1. A lighting device, comprising:

a filament, provided with a long strip bottom, installed with a plurality of LED modules;

a filament fixing element, provided with a bearing surface and a heat dissipation part, the bearing surface connected to the long strip bottom of the filament, the heat dissipation part connected to the bearing surface to dissipate the heat of the bearing surface through the heat dissipation part;

a driving circuit, provided a suitable current to the filament for emitting light;

a lamp holder, housing the drive circuit and carried the filament fixing element;

a bulb shell, constituted an accommodating space with the lamp holder for receiving the filament and the filament fixing element; and a sub-light-bar fixing element, connected to the filament fixing element, and the sub-light-bar fixing element also provided with a filament.

2. The lighting device of claim 1, wherein the filament fixing element comprises a metal plate, the bottom of the metal plate fixed to the lamp holder, the top surface of the metal plate provided with the bearing surface, a main portion of the metal plate used as the heat dissipation part.

3. The lighting device of claim 2, wherein the filament fixing element has two or more metal plates, the top surface of the two or more metal plates provided with the bearing surface for carrying the two or more filaments, and the two or more metal plates connected to each other to form a three-dimensional unfolded structure, to make the two or more filaments emitted in different directions.

4. The lighting device of claim 3, wherein a corresponding card slot provides between the two or more metal plates for stabilizing the three-dimensional expanded structure of the two or more metal plates.

5. The lighting device of claim 1, wherein the bearing surface of the filament fixing element comprises a groove for arranging the filament.

6. The lighting device of claim 1, wherein the filament fixing element comprises aluminum.

7. The lighting device of claim 1, wherein the filament fixing element has at least one hollow hole.

8. The lighting device of claim 1, wherein the filament fixing element has an optical surface for guiding the light emitted by the filament to a predetermined direction.

9. The lighting device of claim 1, wherein the filament is fixed to the filament fixing element by gluing.

10. The lighting device of claim 9, wherein the filament is fixed to the filament fixing element by heat dissipation glue.

11. The lighting device of claim 1, wherein the heat of the driving circuit is also dissipated through the filament fixing element.

12. The lighting device of claim 1, wherein the lamp holder further comprises a heat dissipation element, the heat dissipation element of the lamp holder assisting the filament fixing element to dissipate heat.

13. The lighting device of claim 1, wherein the filament is provided with a flexible substrate, the plurality of LED modules provided on the flexible substrate, and bearing surface of the filament fixing element curved, to make the long strip bottom of the filament maintained in bent in a predetermined shape.

14. The lighting device of claim 1, wherein the filament fixing element further comprises a conductor for directing the current of the driving circuit to the filament.

15. The lighting device of claim 1, wherein the filament fixing element fixes the filament in an elastic holding manner and provides the conduction of the filament current.

16. The lighting device of claim 1, wherein the filament fixing element comprises a transparent material to make the filament visually suspended in the accommodating space of the bulb shell.

17. The lighting device of claim 1, wherein the filament fixing element is a cross-shaped three-dimensional structure.

* * * * *